US006896248B1

(12) United States Patent
Andulics

(10) Patent No.: US 6,896,248 B1
(45) Date of Patent: May 24, 2005

(54) CLAMPING DEVICE

(75) Inventor: Joseph H. Andulics, Elyria, OH (US)

(73) Assignee: Beckett Air Incorporated, North Ridgeville, OH (US)

( * ) Notice: Subject to any disclaimer, the term of this patent is extended or adjusted under 35 U.S.C. 154(b) by 0 days.

(21) Appl. No.: 10/901,859

(22) Filed: Jul. 28, 2004

(51) Int. Cl.[7] ..... B25B 1/00
(52) U.S. Cl. ..... 269/3; 269/6
(58) Field of Search ..... 269/3, 6, 166–168, 269/95, 204, 203; 81/437

(56) References Cited

U.S. PATENT DOCUMENTS

| | | | | |
|---|---|---|---|---|
| 2,815,778 | A | | 12/1957 | Holman |
| 4,220,322 | A | | 9/1980 | Hobday |
| 4,819,921 | A | | 4/1989 | Takahashi |
| 4,926,722 | A | | 5/1990 | Sorensen et al. |
| 5,009,134 | A | | 4/1991 | Sorensen et al. |
| 5,022,137 | A | | 6/1991 | Sorensen et al. |
| 5,170,682 | A | | 12/1992 | Sorensen et al. |
| 5,197,360 | A | | 3/1993 | Wooster, Jr. |
| 5,222,420 | A | | 6/1993 | Sorensen et al. |
| 5,568,916 | A | | 10/1996 | Gibbons et al. |
| 5,853,168 | A | * | 12/1998 | Drake ..... 269/6 |
| 6,302,386 | B1 | * | 10/2001 | Fuller et al. ..... 269/6 |
| 6,382,608 | B1 | | 5/2002 | Michell |
| 6,641,122 | B2 | * | 11/2003 | Roesch ..... 269/6 |
| 6,746,006 | B2 | * | 6/2004 | Thomas ..... 269/6 |
| 2003/0111172 | A1 | | 6/2003 | Devers |

* cited by examiner

*Primary Examiner*—Lee D. Wilson
(74) *Attorney, Agent, or Firm*—Eschweiler & Associates, LLC

(57) ABSTRACT

The present invention is directed to a clamping device, system, and method for clamping a workpiece. The clamping device comprises a slide bar having a fixed jaw and a selectively movable member slidingly coupled to the slide bar. The movable member comprises a housing having a cylinder coupled thereto, wherein an inlet port associated with the with a first end cap of the cylinder is in selective fluid communication with a pressurized fluid source. The pressurized fluid source is operable to linearly translate a piston within the cylinder, therein selectively translating a rod and movable jaw to selectively clamp the workpiece between the fixed jaw and the movable jaw based upon an application of fluid pressure to the inlet port. A locking mechanism operable to selectively engage the slide bar is further coupled to the housing, therein selectively preventing a movement of the housing away from the fixed jaw.

20 Claims, 4 Drawing Sheets

CLAMPING DEVICE

TECHNICAL FIELD OF INVENTION

The present invention relates to a clamping device. In particular, the invention relates to a power-assisted hand clamp for selectively clamping a workpiece.

BACKGROUND OF THE INVENTION

Bar clamps have been used for many years for clamping together various articles for various purposes. For example, two articles can be temporarily held together by a conventional bar clamp for joining the two articles together via welding, gluing, or another joining operation. Typically, a manual quick-action bar clamp is desirable in such an operation, wherein the articles can be manually clamped together in a substantially fast and simple clamping operation.

A conventional manual quick-action bar clamp, for example, comprises a bar, a fixed jaw attached to the bar, and a moveable jaw that generally slides along the bar. The moveable jaw further comprises a handle and a drive mechanism coupled to a clamping trigger, wherein the moveable jaw is operable to be advanced along the bar by a manual squeezing of the clamping trigger with respect to the handle. Upon squeezing the clamping trigger, the drive mechanism advances the moveable jaw toward the fixed jaw in a one-way fashion, wherein the moveable jaw is generally prevented from moving away from the fixed jaw. Thus, the moveable jaw is substantially ratcheted along the bar by the drive mechanism, therein providing a clamping force on the articles between the jaws. The conventional quick-action bar clamp, for example, further comprises a quick-release trigger, wherein the quick-release trigger is operable to generally disengage the drive mechanism from the bar, therein generally releasing the clamping force and de-clamping the articles.

Conventional manual quick-action bar clamps are advantageous over threaded clamps (e.g., conventional C-clamps or the like), wherein the quick-action bar clamp can be held, clamped, and de-clamped with one hand of the user, therein leaving the user's other hand free to position the articles, or to perform an operation such as a welding together of the articles. Conventional manual quick-action bar clamps, however, have several drawbacks. For example, the conventional drive mechanism is generally ratcheted along the bar by a repeated manual squeezing of the clamping trigger. Also, in order to obtain a sufficient clamping force, the clamping trigger is generally squeezed with a substantial amount of force by the user. Such repetitive and/or substantial squeezing of the clamping trigger, for example, can cause repetitive stress injuries to the hand of the user when the clamp is used on a regular basis, such as in a production environment.

Therefore, a need exists in the art for an ergonomic quick-action bar clamp that is operable to provide a large clamping force while limiting an amount of repetitive stress to the user.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its primary purpose is to present some concepts of the invention in a simplified form as a prelude to the more detailed description that is presented later.

The present invention relates generally to a clamping device, clamping system, and method for clamping a workpiece. In accordance with one aspect of the present invention, a clamping device is provided, wherein the clamping device comprises a slide bar and a fixed jaw generally fixedly coupled to the slide bar. A selectively movable member is further slidingly coupled to the slide bar, wherein the movable member comprises a piston and cylinder assembly for providing a clamping force to the workpiece. The cylinder, for example, comprises a first end cap and a second end cap positioned at opposite ends of the cylinder, wherein an interior region of the cylinder is defined therebetween. The first end cap further comprises an inlet port, wherein the inlet port is in fluid communication with the interior region of the cylinder.

The piston resides within the interior region of the cylinder, and is operable to linearly translate within the cylinder, based upon an application of fluid pressure to the inlet port. The piston is further coupled to a rod extending through the second end cap, wherein a movable jaw is coupled to the rod. The movable jaw is further operable to linearly translate with the piston and to selectively clamp the workpiece between the fixed jaw and the movable jaw based upon the application of fluid pressure to the inlet port. Furthermore, a locking mechanism is coupled to the housing, wherein the locking mechanism is operable to selectively engage the slide bar, therein selectively preventing a movement of the housing away from the fixed jaw.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1A:
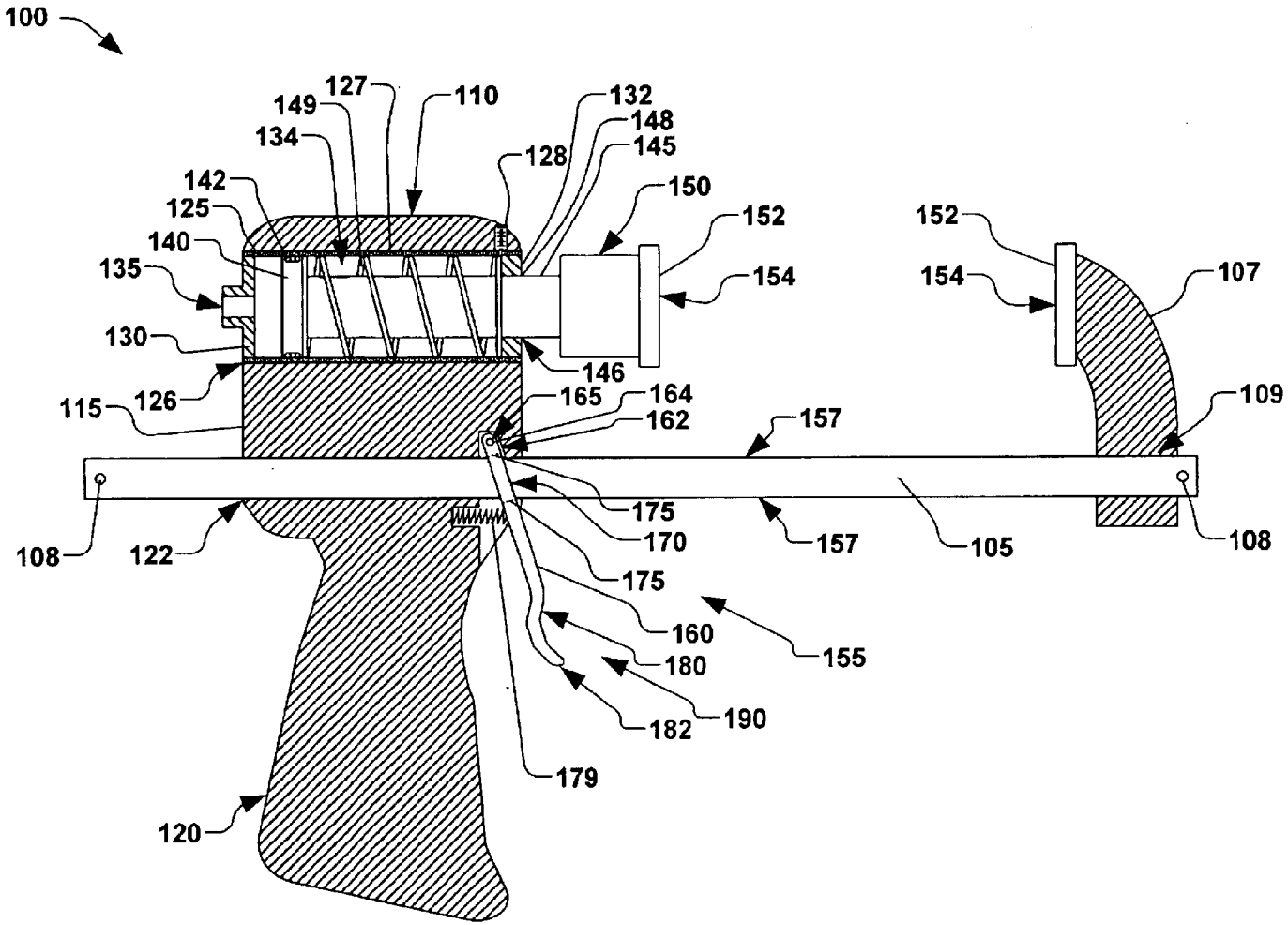
FIG. 1A illustrates a partial cross-sectional view of a clamping device according to one exemplary aspect of the present invention.

The present invention will now be described with reference to the drawings wherein like reference numerals are used to refer to like elements throughout. It should be understood that the description of these aspects are merely illustrative and that they should not be taken in a limiting sense. In the following description, for purposes of explanation, numerous specific details are set forth in order to provide a thorough understanding of the present invention. It will be evident to one skilled in the art, however, that the present invention may be practiced without these specific details. In other instances, well-known structures and devices are shown in block diagram form in order to facilitate description of the present invention.

Figure 1B:
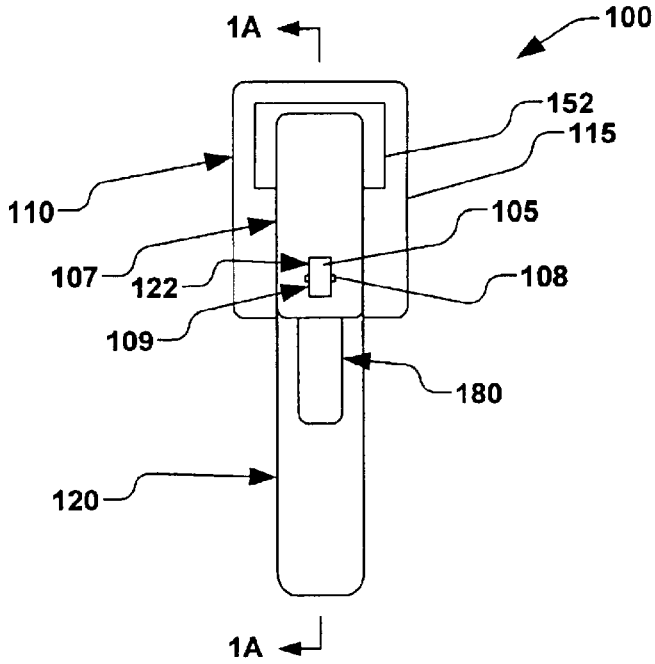
FIG. 1B illustrates a side view of the exemplary clamping device of FIG. 1A in accordance with another exemplary aspect of the invention.

Referring now to the figures, several aspects of the present invention are presented. FIGS. 1A and 1B illustrate a partial cross-sectional view and a side view, respectively, of an exemplary clamping device 100 in accordance with one aspect of the present invention. The clamping device 100 comprises a slide bar 105 and a fixed jaw 107 coupled thereto, wherein the fixed jaw, for example, is generally fixed relative to the slide bar by a pin 108. The fixed jaw 107, for example, comprises a hole 109 therethrough, wherein an orientation of the fixed jaw may be changed in order to provide compressive or expansive clamping.

The clamping device 100 further comprises a selectively movable member 110, wherein the movable member is generally slidingly coupled to the slide bar 105. For example, the movable member comprises a housing 115 having a handle 120 coupled thereto, wherein the housing generally comprises a hole or slot 122 therethrough, wherein the slide bar 105 generally extends through the hole or slot in a generally sliding engagement with the housing. The housing 115, for example, is comprised of a substantially lightweight material, such as a lightweight metal (e.g., aluminum or an aluminum alloy). Alternatively, the housing 115 is comprised of a substantially high yield strength plastic or composite material, wherein a weight of the housing is generally minimized.

The movable member 110, as illustrated in FIG. 1A, further comprises a generally hollow cylinder 125 coupled to the housing 115. The housing 115, for example, comprises a bore 126 therein, wherein the cylinder 125 generally resides. For example, the cylinder 125 comprises a cylinder sleeve 127, wherein the cylinder sleeve 127 is generally fixed with respect to the housing 115 via one or more set screws 128. Alternatively, the cylinder sleeve is press-fit into the bore 126. It should be noted that the cylinder 125 may be alternatively coupled to the housing 115 in any manner, such as being externally coupled to the housing, or wherein the bore 126 in the housing generally defines the cylinder, and all such alternatives are contemplated as falling within the scope of the present invention.

In a preferred embodiment, the cylinder 125 further comprises a first end cap 130 and a second end cap 132, wherein the first end cap and second end cap generally enclose an interior region 134 of the cylinder. The first end cap 130, for example, is associated with a generally hollow first inlet port 135, wherein the first inlet port generally permits a fluid communication between the interior region 134 of the cylinder 125 and a pressurized fluid source (not shown). A piston 140 generally resides within the interior region 134 of the cylinder 125, and is operable to linearly translate within the cylinder, therein generally defining a stroke of the piston. The piston 140 is further operable to translate between the first end cap 130 and the second end cap 132, based upon a fluid pressure provided at the first inlet port 135, wherein one or more o-rings 142 associated with a circumference of the piston, for example, generally provide a dynamic sliding seal between the piston and the cylinder 125.

A rod 145 is operably coupled to the piston 140, wherein the rod generally passes through a hole 146 in the second end cap 132. The second end cap 132, for example, further comprises a seal 148, wherein the seal further provides a dynamic sliding seal between the rod 145 and the second end cap. According to another example, a return spring 149 generally resides within the interior region 134 of the cylinder 125, wherein the return spring is generally biased between the second end cap 132 and the piston 140. Consequently, the return spring 149 generally provides a return force to the piston 140, wherein upon a removal of the fluid pressure to the first inlet port 135, the piston is operable to be translated toward the first end cap 130 via the return spring. Alternatively, a second inlet port (not shown) associated with the second end cap 132 is provided, wherein the second inlet port is in selective fluid communication with the pressurized fluid source (not shown), and wherein upon a removal of the fluid pressure to the first inlet port 135, an application of a fluid pressure to the second inlet port is operable to translate the piston toward the first end cap 130.

According to another exemplary aspect of the present invention, the movable member 110 further comprises a movable jaw 150 generally coupled to the rod 145, wherein the movable jaw is operable to linearly translate with the piston 140. The movable jaw 150, for example, is further operable to engage a workpiece (not shown) between the movable jaw and the fixed jaw 107 upon an application of fluid pressure to the first inlet port 135. In other words, an application of fluid pressure to the first inlet port 135 generally translates the piston 140, the rod 145, and the movable jaw 150 toward the fixed jaw 107, therein selectively providing a clamping force to the workpiece when measured between the movable jaw and the fixed jaw.

According to another example, the movable jaw 150 and/or the fixed jaw 107, further comprise one or more engagement members 152, wherein the one or more engagement members are removably coupled to the respective movable jaw and/or fixed jaw, and wherein the one or more jaw plates generally provide an interfacing surface 154 between the respective jaw and the workpiece (not shown). For example, the one or more engagement members 152 are comprised of a substantially resilient material, such as rubber, wherein the engagement members do not significantly mar or deform the workpiece. Alternatively, the one or more engagement members 152 are comprised of a substantially hard material, such as aluminum or steel, wherein the one or more engagement members are operable to provide a generally precise location of the workpiece between the fixed jaw 107 and the movable jaw 150. The interfacing surface 154, for example, may be patterned (e.g., a cross-hatch or checkerboard pattern imprinted into the engagement member 152), wherein a substantially slip-resistant surface between the respective jaw 107 and 150 and the workpiece is provided.

Figure 2:
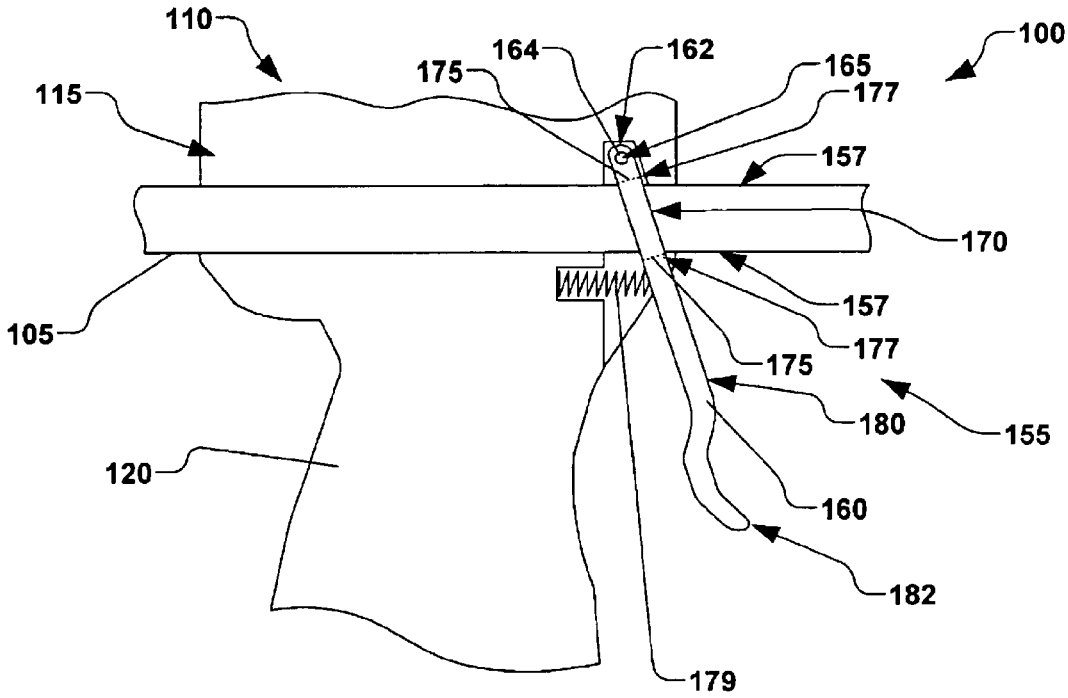
FIG. 2 illustrates an enlarged view of an exemplary locking mechanism according to another aspect of the present invention.

According to another exemplary aspect of the invention, the movable member 110 further comprises a locking mechanism 155 operably coupled to one or more of the housing 115 and handle 120, wherein the locking mechanism is operable to selectively engage the slide bar 105. The locking mechanism 155 is operable to selectively engage one or more surfaces 157 of the slide bar 105, for example, wherein the housing 115 of the movable member 110 is substantially fixed with respect to the slide bar. For example, the locking mechanism 155 comprises a lever 160 pivotally coupled to the housing 115 at a first end 162 of the lever via a pin 164, therein generally defining an axis 165 about which the lever is operable to rotate. FIG. 2 illustrates the locking mechanism 155 in greater detail, wherein the lever 160, for example, further comprises a hole 170 therethrough, wherein the slide bar 105 generally passes through the hole. The hole 170 and the slide bar 105, for example, are generally rectangular in cross-section, wherein the shape of the hole generally relates to the shape of the slide bar 105. The lever 160, for example, is operable to pivot about the axis 165, wherein one or more engagement portions 175 associated with the hole 170 are operable to engage the slide bar 105. Upon an engagement of the one or more engagement portions 175 with the slide bar 105, the housing 115 of the movable member 110 is therefore generally fixed from moving away from the fixed jaw 107.

In accordance with another example, the locking mechanism 155 further comprises a locking spring 179, wherein the locking spring is generally biased between one or more of the handle 120 and housing 115 and the lever 160. The locking spring 179, for example, is operable to exert a force on the lever 160 such that the one or more engagement portions 175 of the lever generally contact and engage the one or more surfaces 160 of the slide bar 105, therein substantially preventing the housing 115 from moving in a direction away from the fixed jaw 107 of FIG. 1. The locking spring 179, for example, may comprise a torsion spring or helical spring, wherein the locking spring is operable to provide a substantial force to the slide bar 105 to generally prevent movement of the housing 115 away from the fixed jaw 107.

In accordance with another exemplary aspect of the invention, the lever 160 generally defines a release trigger 180, wherein a second end 182 of the lever is operable to be pulled toward the handle 120 (e.g., by a finger squeezing the release trigger toward the handle), therein releasing the movable member 110 from the slide bar 105. For example, upon squeezing the release trigger 180, the lever 160 is rotated about the axis 165, therein compressing the locking spring 179 and disengaging the engagement portions 175 of the lever from the slide bar 105. The disengagement of the lever 160 from the slide bar 105 generally permits the movable member 110 to slide toward or away from the fixed jaw 107. Such a release of the movable member 110 generally permits a rough positioning of the movable member along the slide bar or a release of a workpiece being clamped.

Insofar as the locking mechanism 155 is described above as comprising a lever 160 having engagement portions 175 associated with a hole 170 in the lever, other locking mechanisms are also contemplated as falling within the scope of the present invention. For example, the locking mechanism 155 may comprise one or more cams (not shown) coupled to the lever 160, wherein the one or more cams are operable to selectively contact the one or more surfaces 160 of the slide bar 105, therein substantially fixing the housing 115 with respect to the slide bar 105 by generally preventing a movement away from the fixed jaw 107. Alternatively, any locking mechanism 155 operable to selectively fix a position of the housing 115 with respect to the slide bar 105 by generally preventing a movement of the housing away from the fixed jaw 107 is further contemplated as falling within the scope of the present invention.

Figure 3:
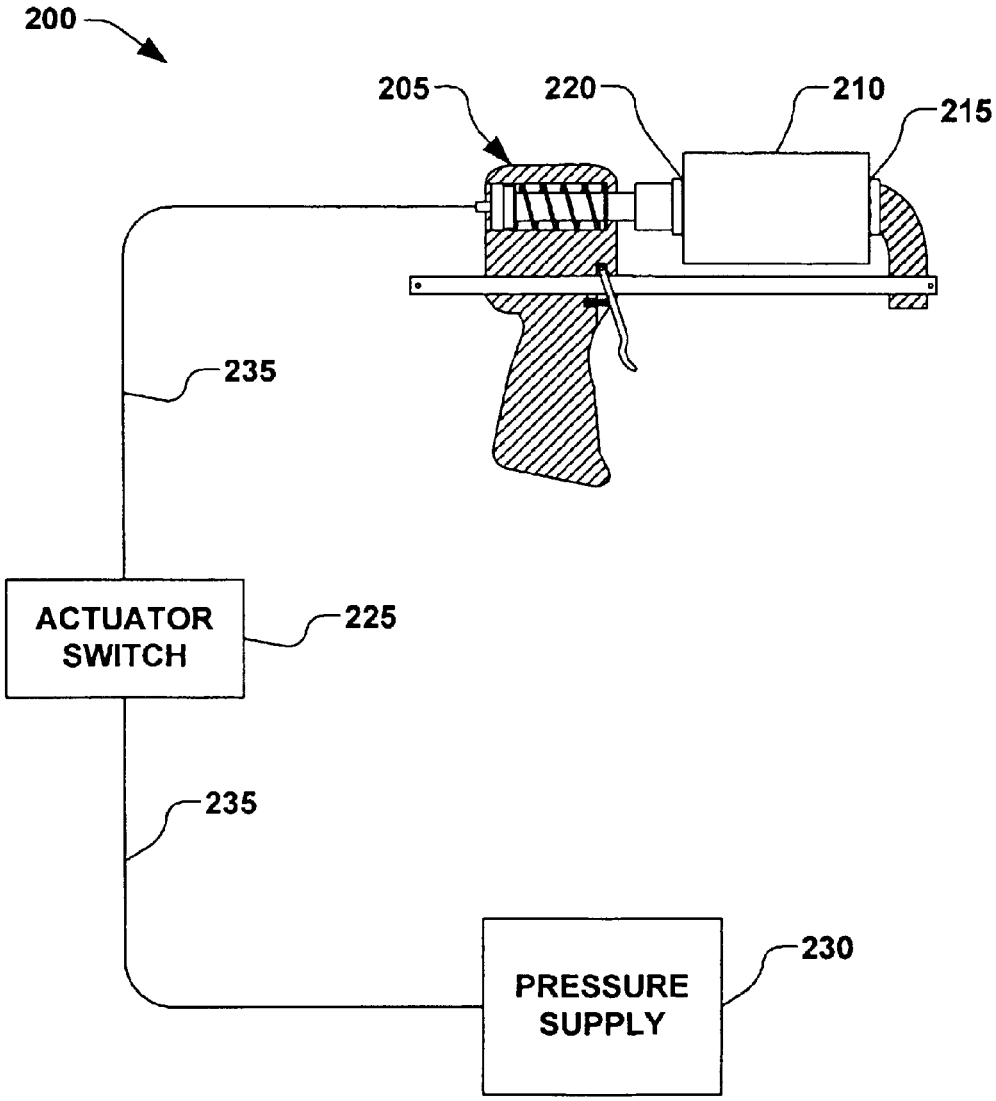
FIG. 3 illustrates a block diagram of a clamping system in accordance with another exemplary aspect of the present invention.

Referring now to FIG. 3, a clamping system 200 is illustrated in accordance with another exemplary aspect of the present invention. The clamping system 200, for example, comprises a clamping device 205, such as the clamping device 100 in FIG. 1, wherein the clamping device is operable to clamp a workpiece 210 between a fixed jaw 215 and a movable jaw 220. The system 200 of FIG. 3 further comprises an actuator switch 225 and a pressurized fluid source 230, wherein the clamping device 205 is in selective fluid communication with the pressurized fluid source via the actuator switch. One or more fluid supply lines 235 provide fluid communication between the clamping device 205 and the actuator switch 225, as well as between the actuator switch and the pressurized fluid source 230. The actuator switch 225, for example, comprises a foot-operated switch (e.g., a pneumatic switch), wherein an operator depresses the switch with their foot, therein freeing up their hands to hold the clamping device 205 and/or workpiece 210. In a further example, a pressure regulator (not shown) is provided in-line with the one or more fluid supply lines 235, wherein the pressure regulator is operable to control an amount of pressure provided to the clamping device 205. Such a control of fluid pressure, for example, can be utilized to control and amount of force exerted on the workpiece 210 between the fixed jaw 215 and movable jaw 220.

Figure 4:
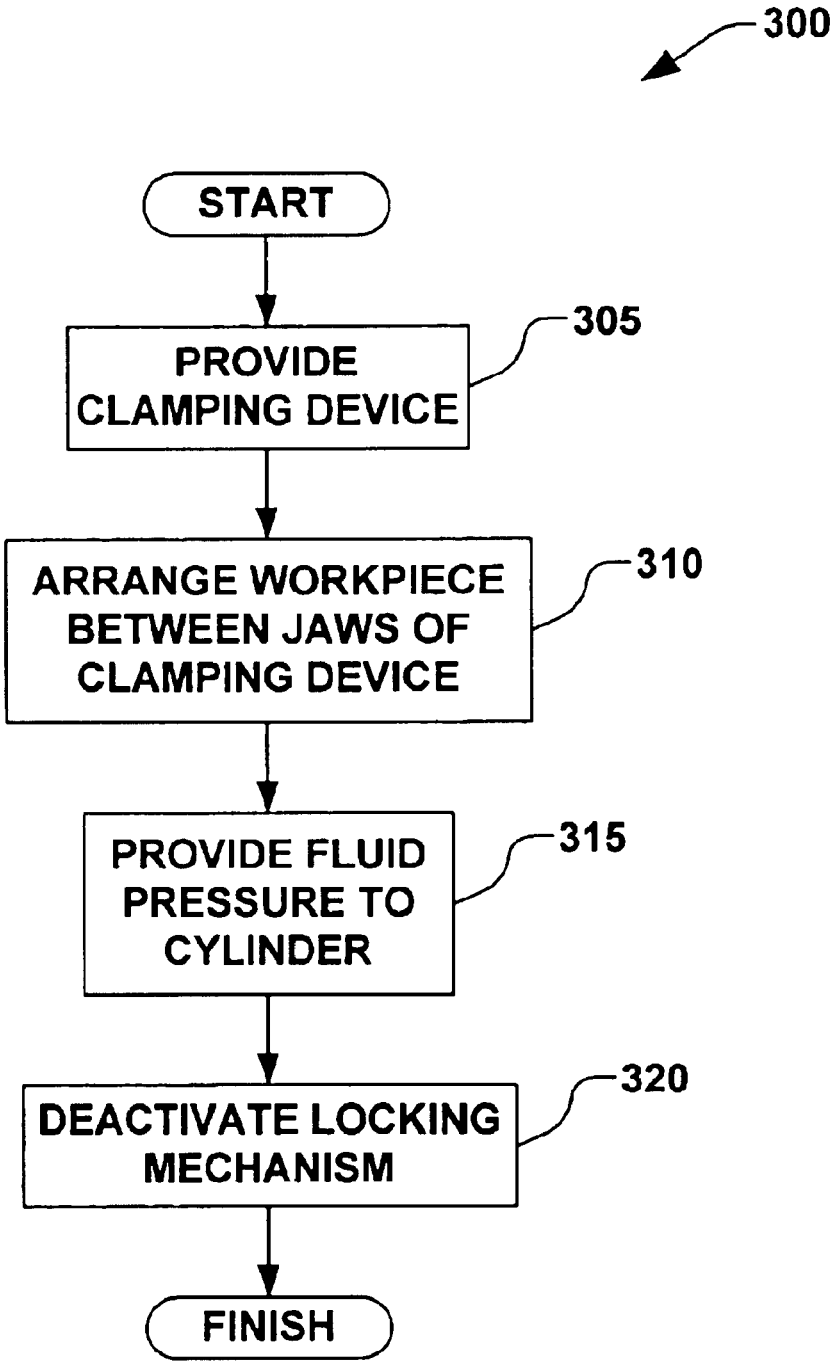
FIG. 4 illustrates a block diagram of a method for clamping a workpiece in accordance with yet another exemplary aspect of the present invention.

FIG. 4 illustrates a method 300 for clamping a workpiece using a clamping device in accordance with another exemplary aspect of the present invention. While exemplary methods are illustrated and described herein as a series of acts or events, it will be appreciated that the present invention is not limited by the illustrated ordering of such acts or events, as some steps may occur in different orders and/or concurrently with other steps apart from that shown and described herein, in accordance with the invention. In addition, not all illustrated steps may be required to implement a methodology in accordance with the present invention. Moreover, it will be appreciated that the methods may be implemented in association with the apparatus and systems illustrated and described herein as well as in association with other systems not illustrated.

The method 300 will now be discussed with reference to the exemplary system 200 of FIG. 3 and exemplary clamping device 100 of FIG. 1. The method 300 of FIG. 4 begins with act 305, wherein a clamping device is provided. For example, the clamping device 100 of FIG. 1 is provided in act 305. In act 310 of FIG. 4, one or more workpieces are arranged between a fixed jaw and a movable jaw of the clamping device. As illustrated in FIG. 3, workpiece 210 is generally positioned between the fixed jaw 215 and the movable jaw 220. The movable member 110, as illustrated in FIG. 1, for example, can be positioned anywhere along the slide bar 105, such that the one more workpieces can be positioned between the jaws. For instance, a gap (not shown) can exist between the workpiece 210 of FIG. 3 and the jaws 215 and 220 after the arrangement of the workpiece in act 310 of FIG. 4. The movable member 110 of FIG. 1, for example, can be subsequently translated along the slide bar 105 in order to contact or nearly contact the workpiece. In such a translation subsequent to act 310, the locking mechanism 155, for example, can be in an activated position 190, as illustrated, wherein the movable member 110 is generally prevented from moving away from the fixed jaw 107. Alternatively, the locking mechanism 155 can be in a deactivated position (not shown), wherein the movable member is free to translate both toward and away from the fixed jaw 105 along the slide bar 105.

In act 315 of FIG. 4, a pressurized fluid is provided to the cylinder, wherein the pressurized fluid generally translates the movable jaw toward the fixed jaw, therein generally clamping the workpiece therebetween. For example, as illustrated in FIG. 3, the actuator switch 225 is enabled, therein providing pressurized fluid (e.g., a pressurized gas such as air, or a non-compressible liquid) through the one or more fluid supply lines 235 and into the interior region 134 of the cylinder 125, as illustrated in FIG. 1. Once clamped in act 315, subsequent operations can be performed on the workpiece 210 (e.g., welding, joining, etc.).

In act 320 of FIG. 4, the locking mechanism is deactivated, wherein the movable member is generally permitted to translate away from the fixed jaw, therein generally declamping the workpiece. After declamping, for example, the workpiece can be removed, and the clamping device can be made ready for clamping a subsequent workpiece.

By utilizing the clamping device of the present invention, a workpiece can be advantageously clamped and declamped in an expeditious manner, while minimizing repetitive stress to the operator's hand. Furthermore, since the clamping device is substantially light in weight, an operator of average strength, for example, can repeatedly use the device, such as in a production environment requiring repeated clamping and declamping operations.

Although the invention has been shown and described with respect to certain aspects, equivalent alterations and modifications will occur to others skilled in the art upon the reading and understanding of this specification and the annexed drawings. In particular regard to the various functions performed by the above described components (systems, devices, assemblies, etc.), the terms used to describe such components are intended to correspond, unless otherwise indicated, to any component which performs the specified function of the described component (i.e., that is functionally equivalent), even though not structurally equivalent to the disclosed structure that performs the function in the herein illustrated exemplary aspects of the invention. In addition, while a particular feature of the invention may have been disclosed with respect to only one of several aspects, such feature may be combined with one or more other features of the other aspects as may be desired and advantageous for any given or particular application. Furthermore, to the extent that the term "includes" is used in either the detailed description and the claims, such term is intended to be inclusive in a manner similar to the term "comprising."

What is claimed is:

1. A clamping device for clamping a workpiece, the clamping device comprising:

a slide bar;

a fixed jaw coupled to the slide bar; and a selectively movable member slidingly coupled to the slide bar, the movable member comprising:

a housing;

a cylinder coupled to the housing, wherein the cylinder comprises a first end cap and a second end cap positioned at opposite ends thereof, wherein an interior region of the cylinder is defined therebetween, and wherein an inlet port is associated with the first end cap, wherein the inlet port is in fluid communication with the interior region of the cylinder;

a piston residing within the interior region of the cylinder, wherein the piston is operable to linearly translate within the cylinder, wherein the piston is further coupled to a rod extending through the second end cap;

a movable jaw coupled to the rod, wherein the movable jaw is operable to linearly translate with the piston and to selectively clamp the workpiece between the fixed jaw and the movable jaw based upon an application of fluid pressure to the inlet port; and a locking mechanism coupled to the housing, wherein the locking mechanism is operable to selectively engage the slide bar, therein selectively preventing a movement of the housing away from the fixed jaw.

2. The clamping device of claim 1, wherein the locking mechanism comprises a locking spring and a lever having a first end pivotally coupled to the housing, the lever further comprising a hole therethrough, wherein the slide bar generally passes through the hole in the lever, wherein the spring generally forces a second end of the lever away from the housing, and wherein the lever further engages the slide bar in an activated position, therein generally preventing a translation of the moveable member away from the fixed jaw in the activated position.

3. The clamping device of claim 1, wherein the locking mechanism comprises one or more cams coupled to a lever, wherein the one or more cams are in selective contact with the slide bar via the lever.

4. The clamping device of claim 1, wherein the housing comprises a bore therethrough, wherein the cylinder generally resides within the bore.

5. The clamping device of claim 1, further comprising a return spring biased between the second end cap and the piston within the interior region of the cylinder.

6. The clamping device of claim 1, wherein the housing is comprised of a lightweight metal or high yield strength plastic.

7. The clamping device of claim 1, wherein the fixed jaw comprises a hole therethrough, and wherein the slide bar is removably coupled to the slide bar, wherein an orientation of the fixed jaw with respect to the slide bar is operable to be reversed.

8. The clamping device of claim 1, wherein the housing comprises a hole therethrough, wherein the slide bar generally passes through the hole in the housing, therein slidingly coupling the movable member to the slide bar.

9. The clamping device of claim 8, wherein the slidebar and hole in the housing are generally rectangular in cross-section.

10. A clamping system for clamping a workpiece, the clamping system comprising:

a pressurized fluid supply;

a clamping device, comprising:

a slide bar;

a fixed jaw coupled to the slide bar; and a selectively movable member slidingly coupled to the slide bar, the movable member comprising:

a housing;

a cylinder coupled to the housing, wherein the cylinder comprises a first end cap and a second end cap positioned at opposite ends thereof, wherein an interior region of the cylinder is defined therebetween, and wherein and inlet port is associated with the first end cap, wherein the inlet port is in fluid communication with the interior region of the cylinder;

a piston residing within the interior region of the cylinder, wherein the piston is operable to linearly translate within the cylinder, wherein the piston is further coupled to a rod extending through the second end cap;

a movable jaw coupled to the rod, wherein the movable jaw is operable to linearly translate with the piston and to selectively clamp the workpiece between the fixed jaw and the movable jaw based upon an application of fluid pressure to the inlet port; and a locking mechanism coupled to the housing, wherein the locking mechanism is operable to selectively engage the slide bar, therein selectively preventing a movement of the housing away from the fixed jaw; and an actuator switch operably coupled to the pressurized fluid supply and the inlet port, wherein the actuator switch is operable to selectively permit fluid communication between the pressurized fluid supply and the inlet port.

11. The clamping system of claim 10, wherein the actuator switch comprises a pneumatic foot switch.

12. The clamping system of claim 10, wherein the pressurized fluid supply comprises a compressed gas source.

13. The clamping system of claim 10, further comprising one or more fluid supply lines coupled to the clamping device, actuator switch, and pressurized fluid source, wherein one or more fluid supply lines provide fluid communication between the clamping device and the actuator switch, as well as between the actuator switch and the pressurized fluid source.

14. The clamping system of claim 10, further comprising a pressure regulator, wherein the pressure regulator is operable to control an amount of fluid pressure supplied to the cylinder.

15. A method of clamping and declamping a workpiece, the method comprising:

providing a clamping device comprising a slide bar having a movable member selectively slidingly coupled thereto and a fixed member fixedly coupled thereto, wherein the movable member further comprises a cylinder having a piston generally disposed therein, the piston being coupled to an end of a rod, wherein a movable jaw is coupled to another end of the rod, the clamping device further comprising a locking mechanism in an activated position, wherein the locking mechanism generally prevents a translation of the movable member away from the fixed jaw in the activated position;

arranging the workpiece between the fixed jaw and the movable jaw;

providing a pressurized fluid to the cylinder, wherein the pressurized fluid generally translates the movable jaw toward the fixed jaw, therein generally clamping the workpiece therebetween; and deactivating the locking mechanism, wherein the movable member is generally permitted to translate away from the fixed jaw, therein generally declamping the workpiece.

16. The method of claim 15, further comprising releasing the pressurized fluid from the cylinder prior to deactivating the locking mechanism.

17. The method of claim 15, wherein arranging the workpiece between the fixed jaw and the movable jaw comprises sliding the movable member toward the fixed jaw.

18. The method of claim 17, wherein sliding the movable member toward the fixed jaw is performed while the locking mechanism is activated.

19. The method of claim 15, wherein the locking mechanism comprises a lever pivotally coupled to the movable member, the lever having a hole therethrough, wherein the slide bar generally passes through the hole, and wherein the lever generally binds against the slide bar in the activated position, therein generally preventing the translating of the movable member away from the fixed jaw.

20. The method of claim 19, wherein deactivating the locking mechanism comprises pivoting the lever coupled to the movable member, therein disengaging the lever from the slide bar.

* * * * *